US006103672A

United States Patent [19]

Dunn et al.

[11] Patent Number: 6,103,672

[45] Date of Patent: Aug. 15, 2000

[54] LUBRICATING OIL COMPOSITIONS

[75] Inventors: Adrian Dunn, Oxford, United Kingdom; Alain Louis Pierre Lenack, Rouen, France; Philip Skinner, Oxfordshire, United Kingdom

[73] Assignee: Exxon Chemical Patents, Inc., Linden, N.J.

[21] Appl. No.: 09/070,905

[22] Filed: May 1, 1998

[30] Foreign Application Priority Data

May 2, 1997 [GB] United Kingdom ..... 9709006

[51] Int. Cl.[7] ..... C10M 105/32

[52] U.S. Cl. ..... 508/185; 508/391; 508/460; 508/586

[58] Field of Search ..... 508/391, 460, 508/523, 525, 586, 185

[56] References Cited

U.S. PATENT DOCUMENTS

| | | | |
|---|---|---|---|
| 4,283,294 | 8/1981 | Clarke | 508/391 |
| 4,394,277 | 7/1983 | Small | 508/185 |
| 4,438,005 | 3/1984 | Zoleski et al. | 508/460 |
| 4,529,526 | 7/1985 | Inoue et al. | 508/365 |
| 4,842,755 | 6/1989 | Dunn | 508/460 |
| 5,492,638 | 2/1996 | Wallace | 508/460 |
| 5,558,802 | 9/1996 | Dowling | 508/586 |
| 5,629,272 | 5/1997 | Nakazato et al. | 508/185 |
| 5,691,283 | 11/1997 | Poat et al. | 508/186 |
| 5,719,107 | 2/1998 | Outten et al. | 508/185 |
| 5,726,133 | 3/1998 | Blahey et al. | 508/390 |

FOREIGN PATENT DOCUMENTS 331359 2/1988 United Kingdom .

*Primary Examiner*—Jacqueline V. Howard
*Assistant Examiner*—Cephia D. Toomer
*Attorney, Agent, or Firm*—Ohlandt, Greeley, Ruggiero & Perle

[57] ABSTRACT

An improved polybutene-free lubricant composition for marine diesel engines, comprising a major amount of oil of lubricating viscosity and, provided by admixing therewith, minor amounts of a) at least one of a borated dispersant or oil-soluble or oil-dispersible boron compound; and b) one or more overbased metal compounds the or each compound having a TBN of at least 300, with the proviso that if an overbased metal salicylate is present then the TBN of said salicylate is at least 200; wherein the TBN of the composition is at least 10 and the viscosity index of the composition is at least 90.

15 Claims, No Drawings

LUBRICATING OIL COMPOSITIONS

This invention relates to an improved lubricating oil composition for marine applications, particularly for use as a marine diesel lubricant for both cross-head engines and trunk piston engines for improving ring wear and linear wear performance. More particularly the present invention relates to an improved cylinder lubricant composition for cross-head engines with improved viscometric properties.

Lubricating oils for cross-head engines and trunk piston engines are known but typically demonstrate poor viscometric properties unless viscosity modifiers, or special and expensive basestocks or brightstocks are used, which are not desirable options from an economic point of view.

EP-A-331359 describes a cylinder lubricant with good viscosity index properties comprising a borated dispersant and a polybutene having a weight average molecular weight of greater than 100,000, and optionally an overbased metal detergent and/or a dithiophosphate anti-wear additive, that has good wear performance.

It is believed that a lubricant having a high viscosity index will possess increased kinematic viscosity at higher temperatures, particularly at the typical operating temperatures of marine diesel engines, for example a cross-head engine, and therefore result in a reduction in wear. Thus lubricants with superior viscometric properties, such as high viscosity index properties, are desirable for reducing the high temperature wear of such diesel engines. Such lubricants may also allow for the design of engines with increased power output, and which operate at higher temperatures.

However, a problem with the lubricants described in the above mentioned EP-A-331359 is the need for high weight average molecular weight polybutene (for example, greater than 100,000), to achieve superior viscometric properties. This invention solves the problem by using defined overbased metal compounds, thereby enabling lubricants with high viscosity properties to be obtained without such a need. Thus, an advantage of the present invention is that lubricants can be formulated cost effectively to achieve high viscosity index properties and so improve wear performance.

Accordingly, a first aspect of the present invention is a polybutene-free cylinder lubricant composition for marine engines comprising a major amount of oil of lubricating viscosity and, provided by admixing therewith, minor amounts of a) at least one of a borated dispersant or an oil-soluble or oil-dispersible boron compound; and b) one or more overbased metal compounds the or each compound having a TBN of at least 300, with the proviso that if an overbased metal salicylate is present then the TBN of said salicylate is at least 200, preferably at least 250, such as at least 265;

wherein the TBN of the composition is at least 10, such as at least 20 and the viscosity index of the composition is at least 90, preferably at least 100, more preferably at least 105.

A second aspect of the present invention is a polybutene-free additive concentrate for marine diesel engines comprising an oil solution, provided by admixing therewith, of a) at least one of a borated dispersant or an oil-soluble or an oil-dispersible boron compound; and b) one or more overbased metal compounds the or each compound having a TBN of at least 300, with the proviso that if an overbased metal salicylate is present then the TBN of said salicylate is at least 200, preferably at least 20, such as at least 265;

the proportions of a) and b) being such that when a polybutene-free lubricant composition is produced from the concentrate composition, the lubricant composition has a TBN of at least 10, such as least 20 and the viscosity index of the lubricant composition is at least 90, preferably at least 100, more preferably at least 105.

A third aspect of the present invention is the use of additives a) and b), in the substantial absence of polybutene, to increase the viscosity index of a lubricant composition for marine diesel engines to be at least 90 and to provide the composition with a TBN of at least 10, wherein a) is at least one of a borated dispersant or an oil-soluble or oil-dispersible boron compound; and b) is one or more overbased metal compounds the or each compound having a TBN of at least 300, with the proviso that if an overbased metal salicylate is present then the TBN of said salicylate is at least 200, preferably at least 250, such as at least 265.

A fourth aspect of the present invention is a method of increasing the viscosity index of a lubricant composition for marine diesel engines to be at least 90 and to provide the composition with a TBN of at least 10, which method comprises including additives a) and b), in the substantial absence of polybutene, in the composition, wherein a) is at least one of a borated dispersant or an oil-soluble or oil-dispersible boron compound; and b) is one or more overbased metal compounds the or each compound having a TBN of at least 300, with the proviso that if an overbased metal salicylate is present then the TBN of said salicylate is at least 200, preferably at least 250, such as at least 265.

Furthermore, a fifth aspect of the present invention is a method of lubricating a marine diesel engine, which comprises supplying to the engine a lubricant composition as defined in the first aspect.

For the purpose of this specification, the TBN (Total Base Number) is as measured by ASTM D2896, and the viscosity index is as defined by ASTM D2270.

The features of the invention will now be discussed in more detail below.

Marine Diesel Engines

The lubricating oil composition of the present invention may be suitable for use in a 4-stroke trunk piston engine having an engine speed of 100–1,500 rpm, e.g. 300–1,000 rpm, and a brake horse-power (BHP) per cylinder of 50–3,000 preferably 100–2,000. The engine can also be a 2-stroke cross-head engine having a speed of 40–200 rpm, preferably 60–120 rpm and a BHP per cylinder of 500–10,000. Preferably, the engine is a cross-head engine.

Lubricant Composition

The term 'polybutene-free' or the phrase 'the substantial absence of polybutene' as used herein means that the lubricant composition contains less than 50 ppm by mass, preferably less than 40 ppm by mass, more preferably less than 20 ppm by mass, of a polybutene having a weight average molecular weight of greater than 100,000, based on the mass of the lubricant composition. Weight average molecular weight (Mw) may be obtained from experimental determinations of molecular weight which depends on the weight of material of different molecular weight. Gel permeation chromatography (GPC) may be used to measure Mw, and ASTM 3593-80 describes a standard method using readily available polystyrene calibration standards.

Preferably, the TBN of the lubricant composition is at least 40, for example in the range of from 50 to 150, such as from 60 to 100. Preferably, the viscosity index of the lubricant composition is at least 110, such as at least 115, especially at least 120.

The lubricant composition may, for example, have a kinematic viscosity at 100° C. (as measured by ASTM D445) of at least 14 centistokes, preferably at least 15 centistokes, more preferably in the range of from 17 to 30 centistokes, for example from 17 to 25 centistokes.

The boron content (measured as elemental boron according to ASTM D5185) in the lubricant composition may, for example, be at least 0.001 mass %, preferably at least 0.01 mass %, more preferably in the range of from 0.01 to 1.0 mass %, especially from 0.01 to 0.5 mass %, such as from 0.01 to 0.1 mass %.

Lubricating Oil

The oil of lubricating viscosity (sometimes referred to as lubricating oil) may be any oil suitable for the lubrication of a cross-head engine or a trunk piston engine. The lubricating oil may suitably be an animal, a vegetable or a mineral oil. Suitably the lubricating oil is a petroleum-derived lubricating oil, such as a naphthenic base, paraffinic base or mixed base oil. Alternatively, the lubricating oil may be a synthetic lubricating oil. Suitable synthetic lubricating oils include synthetic ester lubricating oils, which oils include diesters such as di-octyl adipate, di-octyl sebacate and tri-decyl adipate, or polymeric hydrocarbon lubricating oils, for example liquid polyisobutene and poly-alpha olefins. Commonly, a mineral oil is employed. The lubricating oil may generally comprise greater than 60% by mass, typically greater than 70% by mass of the composition, and typically have a kinematic viscosity at 100° C. of from 2 to 40 centistokes, for example from 3 to 15 centistokes, and a viscosity index of from 80 to 100, for example from 90 to 95.

Another class of lubricating oils is hydrocracked oils, where the refining process further breaks down the middle and heavy distillate fractions in the presence of hydrogen at high temperatures and moderate pressures. Hydrocracked oils typically have kinematic viscosity at 100° C. of from 2 to 40 centistokes, for example from 3 to 15 centistokes and a viscosity index typically in the range of from 100 to 110, for example from 105 to 108.

The term 'brightstock' as used herein refers to base oils which are solvent-extracted, de-asphalted products from vacuum residuum generally having a kinematic viscosity at 100° C. of from 28 to 36 centistokes and are typically used in a proportion of less than 30 mass %, preferably less than 20 mass %, more preferably less than 15 mass %, most preferably less than 10 mass %, such as less than 5 mass %, based on the mass of the composition.

Borated Dispersant

Preferably the boron compound of the present invention is a borated dispersant.

Borated ashless dispersant comprises an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. The dispersant may be, for example, selected from oil soluble salts, esters, amino-esters, amides, imides, and oxazolines of long chain hydrocarbon substituted mono and dicarboxylic acids or their anhydrides; thiocarboxylate derivatives of long chain hydrocarbons; long chain aliphatic hydrocarbons having a polyamine attached directly thereto; and Mannich condensation products formed by condensing a long chain substituted phenol with formaldehyde and polyalkylene polyamine.

Processes for reacting polymeric hydrocarbons with unsaturated carboxylic acids, anhydrides or esters and the preparation of derivatives from those compounds are disclosed in U.S. Pat. No. 3,087,936, U.S. Pat. No. 3,172,892, U.S. Pat. No. 3,215,707, U.S. Pat. No. 3,231,587, U.S. Pat. No. 3,231,587, U.S. Pat. No. 3,272,746, U.S. Pat. No. 3,275,554, U.S. Pat. No. 3,381,022, U.S. Pat. No. 3,442,808, U.S. Pat. No. 356,804, U.S. Pat. No. 3,912,764, U.S. Pat. No. 4,110,349, U.S. Pat. No. 4,234,435 and GP-A-1440219.

A class of ashless dispersants comprising ethylene alpha-olefin copolymers and alpha-olefin homo- and copolymers prepared using new metallocene catalyst chemistry, which may have a high degree (e.g. >30%) of terminal vinylidene unsaturation is described in U.S. Pat. Nos. 5,128,056, 5,151,204, 5,200,103, 5,225,092, 5,266,223, 5,334,775; WO-A-94/19436, 94/13709; and EP-A-440506, 513157, 513211. These dispersant are described as having superior viscometric properties as expressed in a ratio of CCS viscosity to kV 100° C.

The term "alpha-olefin" is used herein to denote an olefin of the formula

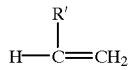

wherein R' is preferably a C1–C18 alkyl group. The requirement for terminal vinylidene unsaturation refers to the presence in the polymer of the following structure:

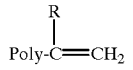

wherein Poly is the polymer chain and R is typically a C1–C18 alkyl group, typically methyl or ethyl. Preferably the polymers will have at least 50%, and most preferably at least 60%, of the polymer chains with terminal vinylidene unsaturation. As indicated in WO-A-94/19436, ethylene/1-butene copolymers typically have vinyl groups terminating no more than about 10 percent of the chains, and internal mono-unsaturation in the balance of the chains. The nature of the unsaturation may be determined by FTIR spectroscopic analysis, titration or C-13 NMR.

The oil-soluble polymeric hydrocarbon backbone may be a homopolymer (e.g., polypropylene) or a copolymer of two or more of such olefins; for example, copolymers of ethylene and an alpha-olefin such as an alpha-olefin containing up to 8, preferably up to 6, such as up to 4 carbon atoms (e.g. propylene, butylene, hexene or octene), or copolymers of two different alpha-olefins. Other copolymers include those in which a minor molar amount of the copolymer monomers, e.g., 1 to 10 mole %, is a $\alpha,\omega$-diene, such as a C3 to C22 non-conjugated diolefin (e.g., a copolymer of isobutylene and butadiene, or a copolymer of ethylene, propylene and 1,4-hexadiene or 5-ethylidene-2-norbornene). Atactic propylene oligomers typically having a $\overline{M}_n$ or from 1000 to 4000 may also be used, as described in EP-A-490454, as well as heteropolymers such as polyepoxides.

One preferred class of olefin polymers is polybutenes and specifically poly-n-butenes, such as may be prepared by polymerization of a C4 refinery stream. Other preferred classes of olefin polymers are EAO copolymers that preferably contain 1 to 50 mole % ethylene, and more preferably 5 to 48 mole % ethylene. Such polymers may contain more than one alpha-olefin and may contain one or more C3 to C22 diolefins. Also usable are mixtures of EAO's of varying ethylene content. Different polymer types, e.g., EAO, may also be mixed or blended, as well as polymers differing in $\overline{M}_n$; components derived from these also may be mixed or blended.

The olefin polymers and copolymers used in the dispersant employed in the invention preferably have an $\overline{M}_n$ of from 1000 to 4000, more preferably at least 1100, advantageously at least 1200, for example 1300 to 4000, especially 1600 to 4000, such as from 2000 to 4000. Polymer molecular weight, specifically $\overline{M}_n$, can be determined by various known techniques. One convenient method is gel permeation chromatography (GPC), which additionally provides molecular weight distribution information (see W. W. Yau, J. J. Kirkland and D. D. Bly, "Modern Size Exclusion Liquid Chromatography", John Wiley and Sons, New York, 1979). Another useful method, particularly for lower molecular weight polymers, is vapor pressure osmometry (see, e.g., ASTM D3592).

The degree of polymerisation Dp of a polymer is $$D_p = \sum_i \frac{\text{Mn} \times \text{mol. \% monomer } i}{100 \times \text{mol. wt monomer } i}$$

and thus for the copolymers of two monomers Dp may be calculated as follows:

$$D_p = \frac{\text{Mn} \times \text{mol. \% monomer 1}}{100 \times \text{mol. wt monomer 1}} + \frac{\text{Mn} \times \text{mol. \% monomer 2}}{100 \times \text{mol. wt monomer 2}}$$

Preferably, the degree of polymerisation for the polymer backbones used in the invention is at least 45, typically from 50 to 165, more preferably 55 to 140.

Particularly preferred copolymers are ethylene butene copolymers.

Preferably, the olefin polymers and copolymers may be prepared by various catalytic polymerization processes using metallocene catalysts which are, for example, bulky ligand transition metal compounds of the formula:

[L]mM[A]n where L is a bulky ligand; A is a leaving group, M is a transition metal, and m and n are such that the total ligand valency corresponds to the transition metal valency. Preferably the catalyst is four co-ordinate such that the compound is ionizable to a $1^+$ valency state.

The ligands L and A may be bridged to each other, and if two ligands A and/or L are present, they may be bridged. The metallocene compound may be a full sandwich compound having two or more ligands L which may be cyclopentadienyl ligands or cyclopentadienyl derived ligands, or they may be half sandwich compounds having one such ligand L. The ligand may be mono- or polynuclear or any other ligand capable of η-5 bonding to the transition metal.

One or more of the ligands may π-bond to the transition metal atom, which may be a Group 4, 5 or 6 transition metal and/or lanthanide or actinide transition metal, with zirconium, titanium and hafnium being particularly preferred.

The ligands may be substituted or unsubstituted, and mono-, di, tri, tetra- and penta-substitution of the cyclopentadienyl ring is possible. Optionally the substituent(s) may act as one or more bridges between the ligands and/or leaving groups and/or transition metal. Such bridges typically comprise one or more of a carbon, germanium, silicon, phosphorus or nitrogen atom-containing radical, and preferably the bridge places a one-atom link between the entities being bridged, although that atom may and often does carry other substituents.

The metallocene may also contain a further displaceable ligand, preferably displaced by a cocatalyst—a leaving group13 that is usually selected from a wide variety of hydrocarbyl groups and halogens.

Such polymerizations, catalysts, and cocatalysts or activators are described, for example, in U.S. Pat. Nos. 4,530,914, 4,665,208, 4,808,561, 4,871,705, 4,897,455, 4,937,299, 4,952,716, 5,017,714, 5,055,438, 5,057,475, 5,064,802, 5,096,867, 5,120,867, 5,124,418, 5,153,157, 5,198,401, 5,227,440, 5,241,025; EP-A-129368, 277003, 27004, 420436, 520732; and WO-A-91/04257, 92/00333, 93/08199, 93/08221, 94/07928 and 94/13715.

The oil-soluble polymeric hydrocarbon backbone may be functionalized to incorporate a function group into the backbone of the polymer, or as one or more groups pendant from the polymer backbone. The functional group typically will be polar and contain one or more hetero atoms such as P, O, S, N, halogen, or boron. It can be attached to a saturated hydrocarbon part of the oil-soluble polymeric hydrocarbon backbone via substitution reactions or to an olefinic portion via addition or cycloaddition reactions. Alternatively, the functional group can be incorporated into the polymer in conjunction with oxidation or cleavage of the polymer chain end (e.g., as in ozonolysis).

Useful functionalization reactions include: halogenation of the polymer at an olefinic bond and subsequent reaction of the halogenated polymer with an ethylenically unsaturated functional compound (e.g., maleation where the polymer is reacted with maleic acid or anhydride); reaction of the polymer with an unsaturated functional compound by the "ene" reaction absent halogenation; reaction of the polymer with at least one phenol group (this permits derivatization in a Mannich base-type condensation); reaction of the polymer at a point of unsaturation with carbon monoxide using a Koch-type reaction to introduce a carbonyl group in an iso or neo position; reaction of the polymer with the functionalizing compound by free radical addition using a free radical catalyst; reaction with a thiocarboxylic acid derivative; and reaction of the polymer by air oxidation methods, epoxidation, chloroamination, or ozonolysis.

The functionalized oil-soluble polymeric hydrocarbon backbone is then further derivatized with a nucleophilic reactant such as an amine, amino-alcohol, alcohol, metal compound or mixture thereof to form a corresponding derivative. Useful amine compounds for derivatizing functionalized polymers comprise at least one amine and can comprise one or more additional amine or other reactive or polar groups. These amines may be hydrocarbyl amines or may be predominantly hydrocarbyl amines in which the hydrocarbyl group includes other groups, e.g., hydroxy groups, alkoxy groups, amide groups, nitriles, imidazoline groups, and the like. Particularly useful amine compounds include mono- and polyamines, e.g. polyalkylene and polyoxyalkylene polyamines of about 2 to 60, conveniently 2 to 40 (e.g., 3 to 20), total carbon atoms and about 1 to 12, conveniently 3 to 12, and preferably 3 to 9 nitrogen atoms in the molecule. Mixtures of amine compounds may advantageously be used such as those prepared by reaction of alkylene dihalide with ammonia. Preferred amines are aliphatic saturated amines, including, e.g., 1,2-diaminoethane; 1,3-diaminopropane; 1,4-diaminobutane; 1,6-diaminohexane; polyethylene amines such as diethylene triamine; triethylene tetramine; tetraethylene pentamine; and polypropyleneamines such as 1,2-propylene diamine; and di-(1,2-propylene)triamine.

Other useful amine compounds include: alicyclic diamines such as 1,4-di(aminomethyl) cyclohexane, and heterocyclic nitrogen compounds such as imidazolines. A particularly useful class of amines are the polyamido and related amido-amines as disclosed in U.S. Pat. Nos. 4,857,217; 4,956,107; 4,963,275; and 5,229,022. Also usable is tris(hydroxymethyl)amino methane (THAM) as described in U.S. Pat. Nos. 4,102,798; 4,113,639; 4,116,876; and UK 989,409. Dendrimers, star-like amines, and comb-structure amines may also be used. Similarly, one may use the condensed amines disclosed in U.S. Pat. No. 5,053,152. The functionalized polymer is reacted with the amine compound according to conventional techniques as described in EP-A-208,560; U.S. Pat. No. 4,234,435 and U.S. Pat. No. 5,229,022.

The functionalized oil-soluble polymeric hydrocarbon backbones also may be derivatized with hydroxy compounds such as monohydric and polyhydric alcohols or with aromatic compounds such as phenols and naphthols. Polyhydric alcohols are preferred, e.g., alkylene glycols in which the alkylene radical contains from 2 to 8 carbon atoms. Other useful polyhydric alcohols include glycerol, monooleate of glycerol, monostearate of glycerol, monomethyl ether of glycerol, pentaerythritol, dipentaerythritol, and mixtures thereof. An ester dispersant may also be derived from unsaturated alcohols such as allyl alcohol, cinnamyl alcohol, propargyl alcohol, 1-cyclohexane-3-ol, and oleyl alcohol. Still other classes of the alcohols capable of yielding ashless dispersants comprise the ether-alcohols and including, for example, the oxy-alkylene, oxy-arylene. They are exemplified by ether-alcohols having up to 150 oxy-alkylene radicals in which the alkylene radical contains from 1 to 8 carbon atoms. The ester dispersants may be di-esters of succinic acids or acidic esters, i.e., partially esterified succinic acids, as well as partially esterified polyhydric alcohols or phenols, i.e., esters having free alcohols or phenolic hydroxyl radicals. An ester dispersant may be prepared by one of several known methods as illustrated, for example, in U.S. Pat. No. 3,381,022.

A preferred class of dispersants includes those substituted with succinic anhydride groups and reacted with polyethylene amines (e.g., tetraethylene pentamine), aminoalcohols such as trismethylolaminomethane and optionally additional reactants such as alcohols and reactive metals e.g., pentaerythritol, and combinations thereof). Also useful are dispersants wherein a polyamine is attached directly to the backbone by the methods shown in U.S. Pat. Nos. 3,275,554 and 3,565,804 where a halogen group on a halogenated hydrocarbon is displaced with various alkylene polyamines.

Another class of dispersants comprises Mannich base condensation products. Generally, these are prepared by condensing about out mole of an alkyl-substituted mono- or polyhydroxy benzene with about 1 to 2.5 moles of carbonyl compounds (e.g., formaldehyde and paraformaldehyde) and about 0.5 to 2 moles polyalkylene polyamine as disclosed, for example, in U.S. Pat. No. 3,442,808. Such Mannich condensation products may include a polymer product of a metallocene catalysed polymerisation as a substituent on the benzene group or may be reacted with a compound containing such a polymer substituted on a succinic anhydride, in a manner similar to that shown in U.S. Pat. No. 3,442,808.

Examples of functionalized and/or derivatized olefin polymers based on polymers synthesized using metallocene catalyst systems are described in publications identified above.

The dispersant is post-treated by boration, as generally taught in U.S. Pat. Nos. 3,087,936 and 3,254,025. This is readily accomplished by treating an acyl nitrogen-containing dispersant with a boron compound selected from the group consisting of boron oxide, boron halides, boron acids and esters of boron acids, in an amount to provide from about 0.1 atomic proportion of boron for each mole of the acylated nitrogen composition to about 20 atomic proportions of boron for each atomic proportion of nitrogen of the acylated nitrogen composition. Usefully the dispersants contain from about 0.05 to 2.0 wt. %, e.g. 0.05 to 0.7 wt % boron based on the total weight of the borated acyl nitrogen compound. The boron which appears be in the product as dehydrated boric acid polymers (primarily (HBO2)3), is believed to attach to the dispersant imides and diimides as amine salts e.g., the metaborate salt of the diimide. Boration is readily carried out by adding from about 0.05 to 4, e.g., 1 to 3 wt. % (based on the weight of acyl nitrogen compound) of a boron compound, preferably boric acid, usually as a slurry, to the acyl nitrogen compound and heating with stirring at from 135° to 190° C., e.g. 140°–170° C., for from 1 to 5 hours followed by nitrogen stripping. Alternatively, the boron treatment can be carried out by adding boric acid to a hot reaction mixture of the dicarboxylic acid material and amine while removing water.

Preferred borated dispersants are borated ashless hydrocarbyl succinimide dispersants prepared by reacting a hydrocarbyl succinic acid or anhydride with an amine followed by boration. Preferred hydrocarbyl succinic acids or anhydrides are those where the hydrocarbyl group is derived from a polymer of a $C_3$ or $C_4$ monoolefin, especially a polyisobutylene wherein the polyisobutenyl group has a number average molecular weight (Mn) of from 700 to 5,000, more preferably from 900 to 2,500. Such dispersants generally have at least 1, preferably 1 to 2, more preferably 1.1 to 1.8, succinic groups for each polyisobutenyl group.

Another class of preferred borated dispersants are the functionalised and derivatised olefin polymers based on ethylene alpha-olefin polymers previously described, produced using metallocene catalyst systems. These, preferably, have number average molecular weights of from 1600 to 3500, more preferably 2000 to 3500, especially 2500 to 3500.

In general, at least 0.5 mass % of a borated dispersant, based on the active ingredient, is used in a lubricant composition of the invention, preferably in the range of from 0.5 to 5.0 mass %, more preferably in the range of from 1.0 to 3.0 mass %, based on the mass of the composition.

Examples of oil-soluble or oil-dispersible boron compounds are borate esters, which may be orthoborates or metaborates, and are produced by reacting a hydroxy compound and an acidic boron compound, such as boric acid. Particular examples include borate esters of alcohols which may contain atoms other than carbon, hydrogen and oxygen, for example sulfur and/or nitrogen. The alcohols may contain more than one hydroxy group, for example they may be diols and polyols, and include phenols, substituted alkylphenols, hydroxy substituted alkyl benzenes such as resorcinol and catechol. Borate esters with B—S and B—N linkages are also suitable.

Examples of oil-soluble, or oil-dispersible boron compounds are also borated fatty amines, borated epoxides, and borated phospholipids.

Borated amines may be prepared by reacting one or more of the above boron compounds, such as boric acid or borate ester, with a fatty amine, e.g., an amine having from 4 to 18 carbon atoms.

Borated fatty epoxides are generally the reaction products of one or more of the above boron compounds, with at least one epoxide. The borated fatty epoxides are generally known and are disclosed in U.S. Pat. No. 4,584,115.

Borated phospholipids may be prepared by reacting a combination of a phospholipid and a boron compound.

Borate esters may be synthesised from the reaction of a boron source, such as boric acid, and alcohol. The alcohol may be a polyol, such as a 1,3-diol and may have up to 24 carbon atoms.

The alcohol may contain other atoms than carbon and hydrogen, such as sulfur.

further, EP-A-0216909 discloses esters of metaboric acid, and have the following formula:

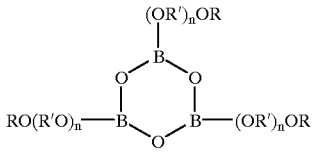

wherein each R is independently hydrogen or a hydrocarbyl group containing from 1 to 18 carbon atoms and each R' is independently an alkylene group containing from 2 to 4 carbon atoms.

Examples of oil-soluble or oil-dispersible boron compounds providing both boron and sulfur are disclosed, for example, in U.S. Pat. No. 3,303,130 which describes an organo thioalkyl borate antiwear agent of the general formula:

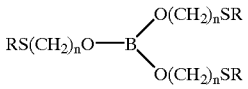

wherein R is selected from the group consisting of hydrogen, alkyl, aryl, alkaryl, aralkyl and cycloalkyl radicals containing 1 to 16 carbon atoms and n is an integer of 2 to 16, inclusive. These compounds are formed by reacting a thioalcohol with boric acid in a molar ratio of at least 3:1, and provide an antiwear additive having a weight ratio of sulfur to boron of 3.33:1. Similar compounds formed by reacting an alcohol, a hydroxysulfide and a boron compound, and the use thereof as a friction reducer in lubricating oil compositions are disclosed in U.S. Pat. No. 4,492,640.

Other examples of borate esters comprising sulfur are those having the general formula (I):

(I)

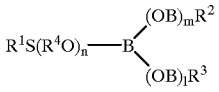

wherein $R^1$ is a hydrocarbyl group having from 4 to 12 carbon atoms, $R^2$ and $R^3$ are independently $—(R^4)_nSR^1$ or $—(OR^4)_nSR^1OH$; $R^4$ is a hydrocarbyl group having from 1 to 6 carbon atoms; n is an integer of from 1 to 4; and l and m are independently 0, 1 or 2;

(II)

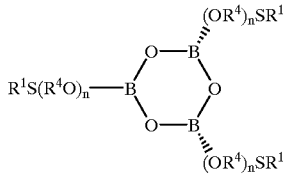

a cyclic metaborate ester having the general formula (II): wherein n, $R^1$ and $R^4$, are defined as in formula (1); or a mixture of one or more borate esters of formula (1) and one or more metaborate esters of formula (II).

In formula (I), it is preferred that $R^1$ is a hydrocarbyl group having from 6 to 9 carbon atoms, $R^4$ is a hydrocarbyl group having from 2 to 4 carbon atoms, and that each of l, m and n is 1. More preferably, $R^1$ has 6 carbon atoms and $R^4$ has 2 carbon atoms.

In formula (II), it is preferred that $R^1$ is a hydrocarbyl group having from 6 to 9 carbon atoms and $R^4$ is a hydrocarbyl group having from 2 to 4 carbon atoms. More preferably, $R^1$ has 6 carbon atoms and $R^4$ has 2 carbon atoms.

The term "hydrocarbyl", as used with reference to boron compounds above, is meant a group that is connected to the remainder of the molecule via a carbon atom, and that contains hydrogen and carbon atoms and that may contain other atoms such as hetero atoms provided they do not interfere with the essentially hydrocarbyl nature of the group.

The hydrocarbyl groups may be the same or different and are preferably alkyl groups.

The above-mentioned borate esters of formulae (I) and (II) may be made as the product of a condensation reaction of an alkoxyalkyl sulfide and boric acid in a molar ratio of at least 1:1. Suitable alkoxyalkyl sulfides are compounds of formula (III):

$$R^1\ (SR^4)\ OH \qquad \text{(III)}$$

wherein $R^1$ and $R^4$ are defined as above, and n is an integer from 1 to 4. Preferable compounds of formula (III) include hydroxyethyldodecyl sulfide, 1-hydroxy-2-methyl-3-thiodecane and hydroxyethyloctyl sulfide (HEOS). The alkoxyalkyl sulfide can compromise a single compound or a mixture thereof.

When reacted with boric acid, the alkoxyalkyl sulfide will form a reaction product that can include both the compound of formula (I) and the compound of formula (II). The reaction strongly favours formation of the compound of formula (II) and the reaction product may, in fact, contain only insignificant amounts, or essentially no, compound of formula (I). The boric acid and hydroxalkyl sulfide are reacted in a molar ratio of about 1:1 or can be reacted in the presence of a slight molar excess of alkoxyalkyl sulfide (no greater than about 2:1). The reaction is conducted at a temperature within a range of from between 60 to 120° C., and at a pressure within a range from between −100 to 0 kPa, preferably from between −70 to −30 kPa.

The boric acid and hydroxalkyl sulfide may be reacted either neat or in an inert or non-participating polar solvent. Using hydroxyethyloctyl sulfide (HEOS) and boric acid reactants as examples, the reaction is believed to proceed as follows:

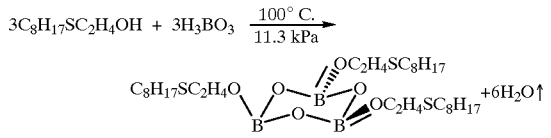

The borate ester may also be derived from glycerol, boric acid and a fatty acid having 8–24 carbon atoms, and may, for example, have one or more of the following formulae:

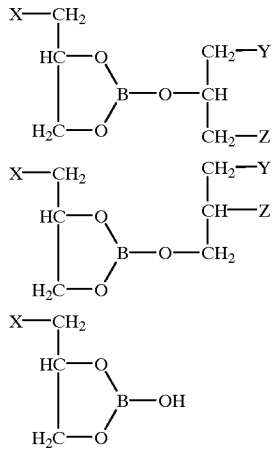

where X, Y and Z are the same or different and each represents a group selected from the group consisting of a hydroxyl group and an alkyl carboxyl group of formula —OCOR where R represents a straight chain or branched chain alkyl group of 7–23 carbon atoms which may be saturated or unsaturated.

Dithiocarbamates salts of boron, such as boron trisdithiocarbamates, are examples of oil-soluble or oil-dispersible boron compounds of the present invention.

Borated detergents may also be used in accordance with the invention; these may be neutral or overbased. Examples of borated detergents include metal salts of surfactants selected from sulfonic acid, salicylic acid, phenol and carboxylic acid. The metal is typically an alkali or alkaline earth metal, such as calcium. Also applicable are dispersions of metal borates where the metal is selected from alkali metal, alkaline earth metal and transition metal.

Overbased Metal Compounds

Overbased metal compounds suitable for use in the lubricant composition of the present invention include alkali metal and alkaline earth metal additives such as overbased oil-soluble or oil-dispersible calcium, magnesium, sodium or barium salts of a surfactant selected from phenol, sulfonic acid, carboxylic acid, salicylic acid and naphthenic acid, wherein the overbasing is an oil-insoluble salt of the metal, e.g. carbonate, basic carbonate, acetate formate, hydroxide or oxalate, which is stabilised by the oil-soluble salt of the surfactant. The metal of the oil-soluble surfactant salt may be the same or different from that of the metal of the oil-insoluble salt. Preferably the metal, whether the metal of the oil-soluble or oil-insoluble salt, is calcium.

Preferably, the TBN of the or each of the overbased metal compounds is at least 330, such as at least 350, more preferably at least 400, most preferably in the range of from 400 to 600, such as up to 500.

Surfactants for the surfactant system of the overbased metal compounds preferably contain at least one hydrocarbyl group, for example, as a substituent on an aromatic ring. The term "hydrocarbyl" as used herein means that the group concerned is primarily composed of hydrogen and carbon atoms but does not exclude the presence of other atoms or groups in a proportion insufficient to detract from the substantially hydrocarbon characteristics of the group. Advantageously hydrocarbyl groups in surfactants for use in accordance with the invention are aliphatic groups, preferably alkyl or alkylene groups, especially alkyl groups, which may be linear or branched. The total number of carbon atoms in the surfactants should be at least sufficient to impart the desired oil-solubility.

Phenols, for use in this invention, may be non-sulfurized or, preferably, sulfurized. Further, the term "phenol" as used herein includes phenols containing more than one hydroxyl group (for example, alkyl catechols) or fused aromatic rings (for example, alkyl naphthols) and phenols which have been modified by chemical reaction, for example, alkylene-bridged phenols and Mannich base-condensed phenols; and saligenin-type phenols (produced by the reaction of a phenol and an aldehyde under basic conditions).

Preferred phenols may be derived from the formula

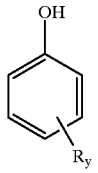

where R represents a hydrocarbyl group and y represents 1 to 4. Where y is greater than 1, the hydrocarbyl groups may be the same or different.

In lubricating oil overbased metal compounds, the phenols are frequently used in sulfurized form. Sulfurized hydrocarbyl phenols may typically be represented by the formula:

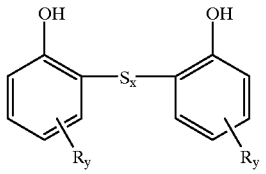

where x is generally from 1 to 4. In some cases, more than two phenol molecules may be linked by $S_x$ bridges.

In the above formulae, hydrocarbyl groups represented by R are advantageously alkyl groups, which advantageously contain 5 to 1000 carbon atoms, preferably 5 to 40 carbon atoms, especially 9 to 12 carbon atoms, the average number of carbon atoms in all of the R groups being at least about 9 in order to ensure adequate solubility in oil. Preferred alkyl groups are nonyl (tripropylene) groups.

In the following discussion, hydrocarbyl-substituted phenols will for convenience be referred to as alkyl phenols.

A sulfurizing agent for use in preparing a sulfurized phenol or phenate may be any compound or element which introduces —$(S)_x$— bridging groups between the alkyl phenol monomer groups, wherein x is generally from 1 to about 4. Thus, the reaction may be conducted with elemental sulfur or a halide thereof, for example, sulfur dichloride or, more preferably, sulfur monochloride. If elemental sulfur is used, the sulfurization reaction may be effected by heating the alkyl phenol compound at from 50 to 250° C., and preferably at least 100° C. The use of elemental sulfur will typically yield a mixture of bridging groups —$(S)_x$— as described above. If a sulfur halide is used, the sulfurization reaction may be effected by treating the alkyl phenol at from −10° C. to 120° C., preferably at least 60° C. The reaction may be conducted in the presence of a suitable diluent. The diluent advantageously comprises a substantially inert organic diluent, for example mineral oil or an alkane. In any event, the reaction is conducted for a period of time sufficient to effect substantial reaction. It is generally preferred to employ from 0.1 to 5 moles of the alkyl phenol material per equivalent of sulphurizing agent.

Where elemental sulfur is used as the sulfurizing agent, it may be desirable to use a basic catalyst, for example, sodium hydroxide or an organic amine, preferably a heterocyclic amine (e.g., morpholine).

Details of sulfurization processes are well known to those skilled in the art.

Regardless of the manner in which they are prepared, sulfurized alkyl phenols useful in preparing overbased metal compounds generally comprise diluent and unreacted alkyl phenols and generally contain from 2 to 20 mass %, preferably 4 to 14 mass %, and most preferably 6 to 12 mass %, sulfur based on the mass of the sulfurized alkyl phenol.

As indicated above, the term "phenol" as used herein includes phenols which have been modified by chemical reaction with, for example, an aldehyde, and Mannich base-condensed phenols.

Aldehydes with which phenols may be modified include, for example, formaldehyde, propionaldehyde and butyraldehyde. The preferred aldehyde is formaldehyde. Aldehyde-modified phenols suitable for use are described in, for example, U.S. Pat. No. 5,259,967.

Mannich base-condensed phenols are prepared by the reaction of a phenol, an aldehyde and an amine. Examples of suitable Mannich base-condensed phenols are described in GP-A-2 121 432.

In general, the phenols may include substituents other than those mentioned above provided that such substituents do not detract significantly from the surfactant properties of the phenols. Examples of such substituents are methoxy groups and halogen atoms.

Salicylic acids used in accordance with the invention may be non-sulfurized or sulfurized, and may be chemically modified and/or contain additional substituents, for example, as discussed above for phenols. Processes similar to those described above may also be used for sulfurizing a hydrocarbyl-substituted salicylic acid, and are well known to those skilled in the art. Salicylic acids are typically prepared by the carboxylation, by the Kolbe-Schmitt process of phenoxides, and in that case, will generally be obtained (normally in a diluent) in admixture with uncarboxylated phenol.

Preferred substituents in oil-soluble salicylic acids from which overbased detergents in accordance with the invention may be derived are the substituents represented by R in the above discussion of phenols. In alkyl-substituted salicylic acids, the alkyl groups advantageously contain 5 to 100 carbon atoms, preferably 9 to 30 carbon atoms, especially 14 to 20 carbon atoms.

Sulfonic acids used in accordance with the invention are typically obtained by sulfonation of hydrocarbyl-substituted, especially alkyl-substituted, aromatic hydrocarbons, for example, those obtained from the fractionation of petroleum by distillation and/or extraction, or by the alkylation of aromatic hydrocarbons. Examples include those obtained by alkylating benzene, toluene, xylene, naphthalene, biphenyl or their halogen derivatives, for example, chlorobenzene, chlorotoluene or chloronaphthalene. Alkylation of aromatic hydrocarbons may be carried out in the presence of a catalyst with alkylating agents having from about 3 to more than 100 carbon atoms, such as, for example, haloparaffins, olefins that may be obtained by dehydrogenation of paraffins, and polyolefins, for example, polymers of ethylene, propylene, and/or butene. The alkylaryl sulphonic acids usually contain from about 7 to about 100 or more carbon atoms. They preferably contain from about 16 to about 80 carbon atoms, or 12 to 40 carbon atoms, per alkyl-substituted aromatic moiety, depending on the source from which they are obtained.

When neutralizing these alkylaryl sulfonic acids to provide sulfonates, hydrocarbon solvents and/or diluent oils may also be included in the reaction mixture, as well as promoters and viscosity control agents.

Another type of sulfonic acid which may be used in accordance with the invention comprises alkyl phenol sulfonic acids. Such sulfonic acids can be sulfurized. Whether sulfurized or non-sulfurized these sulfonic acids are believed to have surfactant properties comparable to those of sulfonic acids, rather than surfactant properties comparable to those of phenols.

Sulfonic acids suitable for use in accordance with the invention also include alkyl sulfonic acids, such as alkenyl sulfonic acids. In such compounds the alkyl group suitably contains 9 to 100 carbon atoms, advantageously 12 to 80 carbon atoms, especially 16 to 60 carbon atoms.

Carboxylic acids which may be used in accordance with the invention include mono- and dicarboxylic acids. Preferred monocarboxylic acids are those containing 1 to 30 carbon atoms, especially 8 to 24 carbon atoms. (Where this specification indicates the number of carbon atoms in a carboxylic acid, the carbon atom(s) in the carboxylic group (s) is/are included in that number.) Examples of monocarboxylic acids are iso-octanoic acid, stearic acid, oleic acid, palmitic acid and behenic acid. Iso-octanoic acid may, if desired, be used in the form of the mixture of C8 acid isomers sold by Exxon Chemical under the trade name "Cekanoic". Other suitable acids are those with tertiary substitution at the α-carbon atom and dicarboxylic acids with more than 2 carbon atoms separating the carboxylic groups. Further, dicarboxylic acids with more than 35 carbon atoms, for example, 36 to 100 carbon atoms, are also suitable. Unsaturated carboxylic acids can be sulphurized. Although salicylic acids contain a carboxylic group, for the purposes of the present specification they are considered to be a separate group of surfactants, and are not considered to be carboxylic acid surfactants. (Nor, although they contain a hydroxyl group, are they considered to be phenol surfactants.)

Examples of other surfactants which may be used in accordance with the invention include the following compounds, and derivatives thereof: naphthenic acids, especially naphthenic acids containing one or more alkyl groups, dialkylphosphonic acids, dialkylthiophosphonic acids, and dialkyldithiophosphoric acids, high molecular weight (preferably ethoxylated) alcohols, dithiocarbamic acids, thiophosphines, and dispersants. Surfactants of these types are well known to those skilled in the art. Surfactants of the type hydrocarbyl-substituted carboxylalkylene-linked phenols, or dihydrocarbyl esters of alkylene dicarboxylic acids, the alkylene group being substituted with a hydroxy group and an additional carboxylic acid group, or alkylene-linked polyaromatic molecules, the aromatic moieties whereof comprise at least one hydrocarbyl-substituted phenol and at least one carboxy phenol, may also be suitable for use in the present invention; such surfactants are described in EP-A-708171.

Also suitable for use in the present invention are overbased metal compounds, preferably overbased calcium detergents, that contain at least two surfactant groups, such as phenol, sulfonic acid, carboxylic acid, salicylic acid and naphthenic acid, that may be obtained by manufacture of a hybrid material in which two or more different surfactant groups are incorporated during the overbasing process.

Examples of hybrid materials are an overbased calcium salt of surfactants phenol and sulfonic acid; an overbased calcium salt of surfactants phenol and carboxylic acid; an overbased calcium salt of surfactants phenol, sulfonic acid and salicylic acid; and an overbased calcium salt of surfactants phenol and salicylic acid.

By an "overbased calcium salt of surfactants" is meant an overbased detergent in which the metal cations of the oil-insoluble metal salt are essentially calcium cations. Small amounts of other cations may be present in the oil-insoluble metal salt, but typically at least 80 mole %, more typically at least 90 mole %, for example at least 95 mole %, of the cations in the oil-insoluble metal salt, are calcium ions. Cations other than calcium may be derived, for example, from the use in the manufacture of the overbased detergent of a surfactant salt in which the cation is a metal other than calcium. Preferably, the metal salt of the surfactant is also calcium.

Preferably, the TBN of the overbased calcium detergent is at least 330, such as at least 350, more preferably at least 400, most preferably in the range of from 400 to 600, such as up to 500.

In the instance where at least two overbased metal compounds are present, any suitable proportions by mass may be used, preferably the mass to mass proportion of any one overbased metal compound to any other metal overbased compound is in the range of from 5:95 to 95:5; such as from 90:10 to 10:90; more preferably from 20:80 to 80:20; especially from 70:30 to 30:70; advantageously from 60:40 to 40:60.

Particular examples of hybrid materials include:

i) an overbased calcium detergent comprising a surfactant system derivable, and preferably derived, from at least two surfactants, at least one of which is a phenol or a derivative thereof and the other, or at least one other, of which is a surfactant other than a phenol surfactant, the proportion, measured as described herein, of said phenol in the surfactant system being at least 10 mass % and the overbased detergent having a TBN:% surfactant ratio (as hereinafter defined) of a least 10.

Independently of the TBN:% surfactant ratio, the proportion of phenol in the surfactant system is at least 20 mass %, preferably at least 40 mass %, more preferably at least 45 mass %, such as in the range of from 50 to 90 mass %. Independently of the phenol proportion, the TBN:% surfactant ratio is at least 11, preferably at least 14, more preferably at least 16, advantageously at least 16, especially at least 19, more especially at least 21, for example at least 25, such as up to 30 or more, or up to 40 or more.

ii) an overbased calcium detergent comprising a surfactant system derivable, and preferably derived, from at least two surfactants, at least one of which is a salicylic acid or a derivative thereof, and the other, or at least one other, of which is a surfactant other than a salicyclic acid surfactant, the proportion, measured as described herein, of the said salicylic acid in the surfactant system being at least 10 mass %, and the overbased detergent having a TBN:% surfactant ratio (as hereinafter defined) of at least 10.

Independently of the TBN:% surfactant ratio, the proportion of salicyclic acid in the surfactant system is at least 20 mass %, preferably at least 30 mass %, more preferably at least 45 mass %, such as in the range of from 50 to 90 mass %. Independently of the salicyclic acid proportion, the TBN:% surfactant ratio is at least 11, preferably at least 14, more preferably at least 16, advantageously at least 18, especially at least 19, more especially at least 21, for example at least 25, such as up to 30 or more, or up to 40 or more.

iii) an overbased calcium detergent comprising a surfactant system derivable, and preferably derived, from phenol and sulfonic acid, the proportions, measured as described herein, of phenol to sulfonic acid in the surfactant system being in the range of from 15:85 to 95:15 mass %, preferably 30:70 to 70:30 mass %, especially 40:60 to 60:40 mass %, and the TBN:% surfactant ratio (as hereinafter defined) of at least 15, preferably at least 17, especially 19 or more.

iv) an overbased calcium detergent comprising a surfactant system derivable, and preferably derived from phenol, salicylic acid and sulfonic acid, the proportions, measured as described herein, of phenol to salicylic acid to sulfonic acid in the surfactant system being in the range of from 5 to 90 mass %; 5 to 90 mass %; 20 to 80 mass %; preferably 20 to 80 mass %; 20 to 80 mass %: 10 to 50 mass %; more preferably 30 to 50 mass %; 25 to 50 mass %; 15 to 35 mass %; and the TBN:% surfactant ratio (as hereinafter defined) of at least 10, preferably at least 12, especially 14 or more.

Preferably, the TBN of the hybrid material is at least 330, such as at least 350, more preferably at least 400, most preferably in the range of from 400 to 600, such as up to 500.

Typically, the amount of overbased metal compound in a lubricant composition is at least 0.5 mass %, based on the active ingredient, particularly in the range of from 0.5 to 20 mass %, based on the mass of the composition, such as from 3 to 12 mass % or 2 to 7 mass %.

The overbased metal compounds of the present invention may be borated, and typically the boron contributing compound, e.g. the metal borate, is considered to form part of the overbasing. In the instance where a borated overbased metal compound is used in the present invention, the use of a borated dispersant and/or an oil-soluble or oil-dispersible boron compound may, or may not, be necessary provided the lubricant composition comprising the borated overbased metal compound has a viscosity index and TBN as defined herein. For the purpose of avoidance of doubt, non-borated dispersants are not excluded in the present invention in combination with a borated overbased metal compound.

Preferably, additives a) and b) are discrete molecules, but additives a) and b) may, if required, be consolidated into a single molecule, for example a borated overbased metal detergent.

The term 'active ingredient' (a.i.) as used herein refers to the additive material that is not diluent.

The terms 'oil-soluble' or 'oil-dispersible' as used herein do not necessarily indicate that the compounds or additives are soluble, dissolvable, miscible or capable of being suspended in the oil in all proportions. These do mean, however, that they are, for instance, soluble or stably dispersible in oil to an extent sufficient to exert their intended effect in the environment in which the oil is employed. Moreover, the additional incorporation of other additives may also permit incorporation of higher levels of a particular additive, if desired.

The lubricant compositions and additive concentrates of this invention comprise defined individual (i.e. separate) components that may or may not remain the same chemically before and after mixing, an example being the additives a) and b) as described herein.

The percentage of surfactant in the overbased calcium detergent, and the percentages of the individual surfactants, for example, phenol, in the surfactant system, are the percentages measured by the method set out below.

1. Dialysis of the overbased detergent

A known amount (A g, approximately 20 g) of the liquid overbased calcium detergent compound (substantially free from other lubricating oil additives) is dialysed through a membrane in a Soxhlet extractor (150 mm height×75 mm internal diameter) using n-hexane siphoning at a rate of 3 to 4 times per hour for 20 hours. The membrane should be one which retains substantially all the metal-containing material, and passes substantially all the remainder of the sample. An example of a suitable membrane is a gum rubber membrane supplied by Carters Products, Division of Carter Wallace Inc., New York, N.Y. 10105 under the trade name Trojans. The dialysate and residue obtained on completion of the dialysis step are evaporated to dryness, any remaining volatile material then being removed in a vacuum oven (100° C. at less than 1 torr or less than about 130 Pa). The mass of the dried residue, in grams, is designated B. The percentage (C) of overbased detergent material in the liquid sample is given by the equation:

$$C = \frac{B}{A} \times 100\%$$

Background information for the dialysis technique is given by Amos, R. and Albaugh, E. W. in "Chromatography in Petroleum, Analysis", Altgelt, K. H. and Gouw, T. H., Eds, pages 417 to 422, Marcel Dekker, Inc., New York and Basel, 1979.

2. Determination of TBN:% total surfactant ratio

A known amount (D g, approximately 10 g) of the dried residue is hydrolyzed as specified in sections 8.1 to 8.1.2 of ASTM D3712, except that at least 200 ml of 25% by volume hydrochloric acid (sp. gr. 1.18) is used in section 8.1.1. The amount of hydrochloric acid used should be sufficient to effect acidification/hydrolysis of the overbased detergent residue into organic materials (surfactants) and inorganic materials (calcium-containing materials, for example, calcium chloride). The combined ether extracts are dried by passing them through anhydrous sodium sulphate. The sodium sulphate is rinsed with clean ether, and the combined ether solutions are evaporated to dryness (at approximately 110° C.) to yield a hydrolyzed residue. The mass of the dried hydrolyzed residue, in grams, is designated E.

The percentage, Y, of total surfactants in the original liquid overbased detergent is given by the equation $$Y = \frac{E}{D} \times C$$

and the TBN:% total surfactant ratio, X, is given by the equation $$X = \frac{TBN \text{ of the liquid overbased detergent}}{Y}$$

It will be noted that, in determining X, the mass of the surfactants in their free form (that is, not in the form of a salt or other derivative) is used.

3. Determination of individual surfactants (in their free form) in the surfactant system The techniques described below isolate the individual surfactants, in hydrolyzed form, from the hydrolyzed surfactant mixture derived from the overbased detergent. As indicated below, the proportion of each individual surfactant is the proportion by mass of the individual surfactant, in hydrolyzed form, in the hydrolyzed surfactant mixture. Thus, where, for example, the overbased detergent contains a calcium phenate/sulphonate/salicylate surfactant system, the proportions of the individual surfactants in the surfactant system are expressed as the proportions of phenol, sulphonic acid and salicylic acid respectively.

The proportions of individual surfactants may be determined by the following method.

A known amount (F g, approximately 1 g) of the dried hydrolyzed residue obtained as described above is placed at the top of a 450×25 mm (internal diameter) fritted glass column filled with 60–100 US mesh Florisil. Florisil is magnesium silicate with a CAS number of 8014-97-9. The column is eluted with a 250 ml portion of each of seven solvents of increasing polarity, namely, heptane, cyclohexane, toluene, ethyl ether, acetone, methanol, and, lastly, a mixture of 50 volume % chloroform, 44 volume % isopropanol, and 6 volume % ammonia solution (sp. gr. 0.88). Each fraction is collected, evaporated to dryness, and the resulting residue is weighed and then analyzed to determine the amount ($G^1$, $G^2$, $G^3$ . . . g) and nature of the surfactant(s) contained in the fraction.

Analysis of the fractions (or of the hydrolyzed residue) can be carried out by, for example, chromatographic, spectroscopic, and/or titration (colour indicator or potentiometric) techniques known to those skilled in the art. Where the overbased detergent contains a sulphonate surfactant and a salicylate surfactant, the sulphonic acid and salicylic acid obtained by hydrolysis of these surfactants will usually be eluted from the column together. In this case, and in any other case where it is necessary to determine the proportion of sulphonic acid in a mixture containing it, the proportion of sulphonic acid in the mixture can be determined by the method described by Epton in Trans. Far. Soc. April 1948, 226.

In the above method, the mass (in grams, designated $H^1$) of a given surfactant, in hydrolyzed form, is determined from the fraction(s) containing it, and thus the proportion of that surfactant in the surfactant system of the original overbased detergent is $$\frac{H^1}{F} \times 100\%$$

The percentages (by mass) of the individual surfactants (in their free form, that is, not in the form of a salt or other derivative) based on the surfactant system can be predicted from the proportions of the surfactants used as starting materials, provided that the percentage of 'reactive ingredient' (r.i.) is known for each of the surfactant starting materials. The percentage of the total surfactants (in their free form) in the liquid overbased product can then be predicted, and the TBN:% surfactant ratio can be determined. As used herein, the term 'reactive ingredient' is the percentage by mass of surfactant that will be associated with the metal calcium.

Lubricating oils suitable for use in marine engines advantageously include an antiwear agent as an additional additive and may also contain other additives, for example, antioxidants, antifoaming agents and/or rust inhibitors.

Oxidation inhibitors, or antioxidants, reduce the tendency of mineral oils to deteriorate in service, evidence of such deterioration being, for example, the production of varnish-like deposits on metal surfaces and of sludge, and viscosity increase. Suitable oxidation inhibitors include sulphurized alkyl phenols and alkali or alkaline earth metal salts thereof; diphenylamines; phenyl-naphthylamines; and phosphosulphurized or sulphurized hydrocarbons.

Other oxidation inhibitors or antioxidants which may be used in lubricating oil compositions comprise oil-soluble copper compounds. The copper may be blended into the oil as any suitable oil-soluble copper compound. By oil-soluble it is meant that the compound is oil-soluble under normal blending conditions in the oil or additive package. The copper may, for example, be in the form of a copper dihydrocarbyl thio- or dithio-phosphate. Alternatively, the copper may be added as the copper salt of a synthetic or natural carboxylic acid, for example, a $C_8$ to $C_{18}$ fatty acid, an unsaturated acid, or a branched carboxylic acid. Also useful are oil-soluble copper dithiocarbamates, sulphonates, phenates, and acetylacetonates. Examples of particularly useful copper compounds are basic, neutral or acidic copper $Cu^I$ and/or $Cu^{II}$ salts derived from alkenyl succinic acids or anhydrides.

Additional detergents and metal rust inhibitors include the metal salts, which may be overbased and have a TBN less than 300, of sulphonic acids, alkyl phenols, sulphurized alkyl phenols, alkyl salicylic acids, thiophosphonic acids, naphthenic acids, and other oil-soluble mono- and dicarboxylic acids. Representative examples of detergents/rust inhibitors, and their methods of preparation, are given in EP-A-208 560. In the case of metal salts of salicylic acids, the TBN of the metal salts may be less than 200.

Antiwear agents, as their name implies, reduce wear of metal parts. Zinc dihydrocarbyl dithiophosphates (ZDDPs) are very widely used as antiwear agents. Especially preferred ZDDPs for use in oil-based compositions are those of the formula $Zn[SP(S)(OR^1)(OR^2)]_2$ wherein $R^1$ and $R^2$ contain from 1 to 18, and preferably 2 to 12, carbon atoms.

Pour point depressants, otherwise known as lube oil flow improvers, lower the minimum temperature at which the fluid will flow or can be poured. Such additives are well known. Foam control may be provided by an antifoamant of the polysiloxane type, for example, silicone oil or polydimethyl siloxane.

Typical proportions for additives for a TPEO (a trunk piston engine oil) are as follows:

| Additive | Mass % a.i.* (Broad) | Mass % a.i.* (Preferred) |
|---|---|---|
| Detergent(s) | 0.5–10 | 2–7 |
| Dispersant(s) | 0.5–5 | 1–3 |
| Anti–wear agent(s) | 0.1–1.5 | 0.5–1.3 |
| Oxidation inhibitor | 0.2–2 | 0.5–1.5 |
| Rust inhibitor | 0.03–0.15 | 0.05–0.1 |
| Pour point depressant | 0.03–0.15 | 0.05–0.1 |
| Mineral or synthetic base oil | Balance | Balance |

*Mass % active ingredient based on the final oil.

Typical proportions for additives for a MDCL (a marine diesel cylinder lubricant) are as follows:

| Additive | Mass % a.i.* (Broad) | Mass % a.i.* (Preferred) |
|---|---|---|
| Detergent(s) | 1–18 | 3–12 |
| Dispersant(s) | 0.5–5 | 1–3 |
| Anti–wear agent(s) | 0.1–1.5 | 0.5–1.3 |
| Pour point depressant | 0.03–0.15 | 0.05–0.1 |
| Mineral or synthetic base oil | Balance | Balance |

*Mass % active ingredient based on the final oil.

When a plurality of additives are employed it may be desirable, although not essential, to prepare one or more additive packages or concentrates comprising the additives, whereby several additives can be added simultaneously to the base oil to form the lubricating oil composition. Dissolution of the additive package(s) into the lubricating oil may be facilitated by solvents and by mixing accompanied with mild heating, but this is not essential. The additive package (s) will typically be formulated to contain the additive(s) in proper amounts to provide the desired concentration, and/or to carry out the intended function, in the final formulation when the additive package(s) is/are combined with a predetermined amount of base lubricant. Thus, components a) and b) in accordance with the present invention may be admixed with small amounts of base oil or other compatible solvents together with other desirable additives to form additive packages containing active ingredients in an amount, based on the additive package, of, for example, from about 2.5 to about 90 mass %, and preferably from about 5 to about 75 mass %, and most preferably from about 8 to about 60 mass % by weight, additives in the appropriate proportions with the remainder being base oil.

The final formulations may typically contain about 5 to 40 mass % of the additive package(s) with the remainder being base oil.

There is also provided in accordance with the present invention, a process for manufacturing a polybutene-free lubricant composition for marine diesel engines comprising admixing a major amount of oil of lubricating viscosity and minor amounts of a) and b) as defined herein, wherein the TBN of the composition is at least 10, such as at least 20 and the viscosity index of the composition is at least 90, preferably at least 100, more preferably at least 105.

EXAMPLES

The present invention is illustrated by but in no way limited to the following examples.

Components

The components used in the examples were as follows.

Overbased Metal Compounds

X—is an overbased calcium salt of surfactants phenol and sulfonic acid (phenate/sulfonate) prepared as follows.

Toulene (selected from the range of from 350–540 g), methanol (selected from the range of from 270–330 g), and water (selected from the range of from 15–26 g) were introduced into a reactor and mixed while maintaining the temperature at approximately 20° C. 11 g of diluent oil was also added and the mixture maintained at 20° C. Calcium hydroxide ($Ca(OH)_2$) (71 g) was added, and the mixture was heated to 40° C., with stirring. To the slurry obtained in this way was added a mixture, maintained at 40° C., of phenol, sulphonic acid, and 100 g toluene, followed by a further quantity (50 g) of toluene.

After neutralization of the surfactants by the calcium hydroxide, the temperature of the mixture was reduced to approximately 28° C. and was maintained at approximately 28° C. while carbon dioxide (31 g) was injected into the mixture at a rate such that substantially all the carbon dioxide was absorbed in the reaction mixture to form the basic material. The temperature was then raised to 60° C. over 60 minutes, following which the mixture was cooled to a temperature of approximately 28° C. over 30 minutes. At 28° C., a further quantity of calcium hydroxide (63 g) was added and carbon dioxide (31 g) was charged. After this second carbonation step, the temperature was raised to 60° C. over 90 minutes.

Subsequently, the polar solvents were distilled off and the product was filtered to remove sediment. The remaining volatile material was then distilled off and diluent oil (122 g) was added.

The phenol used in the preparation above is a sulphurized alkyl phenol, synthesized from sulphur monochloride and a 65/35 (by mass) blend of tertiary nonyl (tripropylene) phenols (predominantly para-substituted) and tertiary dinonyl phenols (predominantly 2,4-substituted) (a.i.=84; r.i.=40); and the sulfonic acid used in the preparation above is an alkyl benzene sulfonic acid derived from $SO_3$ (in liquid $SO_2$) with a molecular mass of 683 (a.i.=96; r.i.=84).

The phenol and sulfonic acid were used in suitable quantities to obtain an overbased metal compound having a TBN of 410 and TBN:% surfactant ratio of 20.

Y—is a high TBN calcium alkyl phenate additive with a typical TBN of 400 supplied as ADX 410 by Adibis.

Z—is a highly overbased calcium alkylsalicylate with a typical TBN of 275 supplied as SAP005 by Shell International Chemical Company Ltd.

Dispersants

P—is a polyisobutenyl succinic anhydried-polyamine reaction product.

Q—is a borated polyisobutenyl succinic anhydride-polyamine reaction product having a typical boron content of 0.35 mass %.

R—is a borated polyisobutenyl succinic anhydride-polyamine reaction product having a typical boron content of 1.3 mass %.

Basestock

The basestock used in a BP 500SN basestock having a viscosity index of 95, supplied by British Petroleum.

Lubricant Compositions and Tests

Lubricant compositions as marine diesel lubricating oils were prepared by admixing with the basestock (a) certain of the overbased metal compounds alone, (b) certain of the dispersants alone, and (c) both of certain of the overbased metal compounds and certain of the dispersants. The admixing was carried out by blending the particular component(s) and the basestock at 60° C. for 1 hour. The components used and their proportions by mass are indicated in Tables 1 and 2 hereinafter as identified examples. Examples identified by numbers are examples of the invention; examples identified by letters are not of the invention and are provided for purposes of comparison.

The lubricating composition of each example was tested by measuring its kinematic viscosity at 40° C. and 100° C. according to the method ASTM D445; the viscosity index (VI) of the composition was calculated from the measured kinematic viscosities. The TBN and the boron content of each composition was calculated from the TBN and the boron content of the components used to make that composition.

Results

The results obtained in the tests are shown in Tables 1 and 2 below.

TABLE 1

| | Example | | | | | | | | | |
|---|---|---|---|---|---|---|---|---|---|---|
| | A | B | C | D | E | F | G | H | I | J |
| overbased metal compound X | 0 | 28 | 60 | 80 | 0 | 0 | 0 | 0 | 0 | 17.4 |
| overbased metal compound Y (1) | 28 | 0 | 0 | 0 | 0 | 0 | 0 | 0 | 0 | 0 |
| Dispersant P (3) | 0 | 0 | 0 | 0 | 3 | 0 | 0 | 0 | 0 | 3 |
| Dispersant Q (4) | 0 | 0 | 0 | 0 | 0 | 3 | 0 | 4 | 0 | 0 |
| Dispersant R (5) | 0 | 0 | 0 | 0 | 0 | 0 | 3 | 0 | 4 | 0 |
| basestock (6) | 72 | 72 | 40 | 20 | 97 | 97 | 97 | 96 | 96 | 79.6 |
| KV 40° C., centistokes | 140.4 | 140.3 | 367.5 | 1021 | 102.3 | 102.8 | 99.86 | 105.6 | 102.1 | 133.3 |
| KV 100° C., centistokes | 14.6 | 14.7 | 29.1 | 60.7 | 11.4 | 11.4 | 11.2 | 11.7 | 11.5 | 14.3 |
| V. INDEX | 103 | 105 | 109 | 116 | 97 | 98 | 98 | 99 | 99 | 105 |
| TBN, mg KOH/g | 112.0 | 116.0 | 246.0 | 328.0 | 0.9 | 0.9 | 0.8 | 1.2 | 1.0 | 72.2 |
| BORON, mass % | 0 | 0 | 0 | 0 | 0 | 0.01 | 0.039 | 0.014 | 0.052 | 0 |

TABLE 2

| | Example | | | | | | | |
|---|---|---|---|---|---|---|---|---|
| | 1 | 2 | 3 | 4 | 5 | 6 | 7 | 8 |
| overbased metal compound X | 0 | 0 | 17.4 | 25 | 25 | 28 | 28 | 60 |
| overbased metal compound Y (1) | 25 | 28 | 0 | 0 | 0 | 0 | 0 | 0 |
| Dispersant Q (4) | 3 | 3 | 3 | 3 | 0 | 3 | 4 | 3 |
| Dispersant R (5) | 0 | 0 | 0 | 0 | 3 | 0 | 0 | 0 |
| basestock (6) | 72 | 69 | 79.6 | 72 | 72 | 69 | 68 | 37 |
| KV 40° C., centistokes | 162.6 | 168.1 | 133.6 | 154.2 | 148.5 | 163.4 | 177.4 | 453.1 |
| KV 100° C., centistokes | 16.5 | 17.0 | 14.6 | 16.8 | 16.5 | 17.2 | 19.3 | 36.5 |
| V. INDEX | 107 | 108 | 109 | 117 | 119 | 114 | 124 | 122 |
| TBN, mg KOH/g | 100.9 | 112.9 | 72.2 | 103.4 | 103.3 | 115.9 | 116.2 | 246.9 |
| BORON, mass % | 0.01 | 0.01 | 0.01 | 0.01 | 0.039 | 0.01 | 0.014 | 0.01 |

| | Example | | | | |
|---|---|---|---|---|---|
| | 9 | 10 | 11 | 12 | 13 |
| overbased metal compound X | 80 | 17.4 | 17.4 | 0 | 0 |
| overbased metal compound Y (1) | 0 | 0 | 0 | 0 | 0 |
| overbased metal compound Z (2) | 0 | 0 | 0 | 17.4 | 17.4 |
| Dispersant Q (4) | 3 | 0 | 0 | 3 | 6 |
| Dispersant R (5) | 0 | 3 | 4 | 0 | 0 |
| basestock (6) | 17 | 79.6 | 78.6 | 79.6 | 76.6 |
| KV 40° C., centistokes | 1367 | 127.4 | 132.9 | 117.3 | 142.3 |
| KV 100° C., centistokes | 80.9 | 14.3 | 15.1 | 14.2 | 18.2 |
| V. INDEX | 128 | 112 | 116 | 121 | 143 |
| TBN, mg KOH/g | 328.0 | 72.1 | 72.3 | 49.2 | 50.1 |
| BORON, mass % | 0.01 | 0.039 | 0.052 | 0.01 | 0.021 |

Comparing the results of Examples A and F of Table 1 with those of Example 2 of Table 2 shows that the composition containing both a borated dispersant and an overbased metal compound (i.e. of the invention) has a higher viscosity index than the compositions containing the same components alone.

The same effect in viscosity index improvement is also apparent on comparing:

i) Examples B and F of Table 1 and Example 6 of Table 2;

ii) Examples C and F of Table 1 and Example 8 of Table 2;

iii) Examples B and H of Table 1 and Example 8 of Table 2; and iv) Examples D and F of Table 1 and Example 9 of Table 2.

Generally, the results of Examples 1 to 13 show that the lubricating compositions containing both a borated dispersant and an overbased metal compound (i.e. of the invention) have surprisingly increased viscosity indices. Moreover, the lubricating compositions of these examples exhibited high visosity indices without the need for them to contain high viscosity index basestocks, or viscosity modifiers, or brightstocks.

Furthermore, a comparison of the results of Examples 3, 10 and 11 with those of Example J shows that the boron-containing compositions, have higher viscosity indices than the composition containing no boron. The results also show that the compositions with a higher mass % of boron have a higher viscosity index. This trend is also clearly seen for Examples 12 and 13.

What is claimed is:

1. A polybutene-free marine diesel cylinder lubricant composition comprising a major amount of oil of lubricating viscosity and, provided by admixing therewith, minor amounts of a) at least one compound selected from the group consisting of a borated dispersant, an oil-soluble boron compound, and an oil-dispersible boron compound; and b) one or more overbased metal compounds, each overbased metal compound having a TBN of at least 300, with the proviso that if an overbased metal salicylate is present then the TBN of said salicylate is at least 200;

wherein the TBN of the composition is at least 10, and the viscosity index of the composition is at least 90 and is greater than a similar composition formed from a non-borated dispersant.

2. The composition of claim 1 wherein the TBN of the composition is at least 40.

3. The composition of claim 1, wherein the viscosity index is at least 115.

4. The composition of claim 1 wherein the TBN of each of the overbased metal compounds is at least 330.

5. The composition of claim 1 wherein the boron content of the composition is at least 0.001 mass %.

6. The composition of claim 1 wherein the kinematic viscosity at 100° C. of the composition is at least 14 centistokes.

7. The composition of claim 1 wherein a second lubricating oil of kinematic viscosity at 100° C. of from 28 to 36 centistokes is present in a proportion of less than 30 mass % based on the mass of the composition.

8. The composition of claim 1 wherein at least one of the overbased metal compounds is an overbased calcium compound.

9. The composition of claim 1 wherein at least one of the overbased metal compounds is a calcium overbased detergent having a TBN of at least 300, said detergent comprising a surfactant system derived from at least two surfactants.

10. The composition of claim 1 wherein at least two overbased metal compounds are present, the mass to mass proportion of any one overbased metal compound to any other overbased metal compounds is in the range of from 5:95 to 95:5.

11. The composition of claim 10 wherein the mass to mass proportion is in the range of from 20:80 to 80:20.

12. A polybutene-free marine diesel cylinder lubricant additive concentrate comprising an oil solution, provided by admixing therewith, a) at least one compound selected from the group consisting of a borated dispersant, an oil-soluble boron compound, and an oil-dispersible boron compound; and one or more overbased metal compounds, each overbased metal compound having a TBN of at least 300; with the proviso that if an overbased metal salicylate is present then the TBN of said salicylate is at least 200;

the proportions of a) and b) being such that when a polybutene-free lubricant composition is produced from the concentrate composition, the lubricant composition has a TBN of at least 10, and the viscosity index of the lubricant composition is at least 90 and is greater than a similar composition formed from a non-borated dispersant.

13. A method for improving ring wear and linear wear performance of a polybutene-free lubricant composition to be used in marine diesel engines, comprising adding to an oil of lubricating viscosity, minor amounts of a) at least one compound selected from the group consisting of a borated dispersant, an oil-soluble boron compound, and an oil-dispersible boron compound; and b) one or more overbased metal compounds, each overbased metal compound having a TBN of at least 300, with the proviso that if an overbased metal salicylate is present then the TBN of said salicylate is at least 200, wherein the TBN of the composition is at least 10, and the viscosity index of the composition is at least 90 and is greater than a similar composition formed from a non-borated dispersant.

14. A method of increasing the viscosity index of a lubricant composition for marine diesel engines to be at least 90 and to be greater than the viscosity index for a similar composition formed from a non-borated dispersant and to provide the composition with a TBN of at least 10, which method comprises adding to a lubricating oil additives a) and b), in the substantial absence of polybutene, wherein a) is at least one compound selected from the group consisting of a borated dispersant, an oil-soluble boron compound, and an oil-dispersible boron compound; and b) is one or more overbased metal compounds, each overbased metal compound having a TBN of at least 300, with the proviso that if an overbased metal salicylate is present then the TBN of said salicylate is at least 200.

15. A method of lubricating a marine diesel engine, which comprises supplying to the engine a lubricant composition as defined in claim 1.

* * * * *